US008695164B2

(12) United States Patent
Chinta et al.

(10) Patent No.: US 8,695,164 B2
(45) Date of Patent: Apr. 15, 2014

(54) CHECK LINK ASSEMBLY WITH ADJUSTABLE DETENT FEATURE

(75) Inventors: Balakrishna Chinta, Troy, MI (US); Raymond R. Lipowski, Troy, MI (US); Tze On Hui, Novi, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/483,554

(22) Filed: May 30, 2012

(65) Prior Publication Data

US 2013/0318743 A1 Dec. 5, 2013

(51) Int. Cl.
*E05C 17/22* (2006.01)

(52) U.S. Cl.
USPC ..... 16/86 C

(58) Field of Classification Search
USPC ..... 16/82, 86 C; 292/252, 163, DIG. 15, 292/DIG. 60
See application file for complete search history.

(56) References Cited

U.S. PATENT DOCUMENTS

| | | | | | |
|---|---|---|---|---|---|
| 5,461,754 | A * | 10/1995 | Tillmann et al. | ..... | 16/82 |
| 6,009,597 | A * | 1/2000 | Yu | ..... | 16/85 |
| 6,176,040 | B1 * | 1/2001 | Sugihara | ..... | 49/394 |

FOREIGN PATENT DOCUMENTS

| | | | | | |
|---|---|---|---|---|---|
| DE | 3546009 | A1 * | 6/1987 | ..... | E05C 17/18 |
| JP | 08268063 | A * | 10/1996 | ..... | B60J 5/00 |
| JP | 2010095855 | A * | 4/2010 | | |

* cited by examiner

*Primary Examiner* — Victor Batson
*Assistant Examiner* — Matthew Sullivan
(74) *Attorney, Agent, or Firm* — Quinn Law Group, PLLC

(57) ABSTRACT

A check link assembly for positioning a vehicle closure has a selectively positionable detent feature. The check link assembly includes an elongated link having a distal end. At least one cover is attachable to the link in a first orientation and in a second orientation. The cover has a first end, a second end, and a contoured surface between the first end and the second end. At least one member is biased against the link and is configured to ride against the contoured surface of the cover. The contoured surface at least partially defines a detent feature that interferes with the biased member to increase resistance to relative movement of the link and the biased member, thereby establishing a stop position. The detent feature is further from the distal end of the link when the cover is in the first orientation than when the cover is in the second orientation.

19 Claims, 6 Drawing Sheets

CHECK LINK ASSEMBLY WITH ADJUSTABLE DETENT FEATURE

TECHNICAL FIELD

The present teachings generally include a check link assembly such as for positioning a vehicle closure.

BACKGROUND

Automotive vehicles include a vehicle body defining an interior compartment, such as a passenger compartment or a cargo compartment. Closures such as doors are selectively movable between open and closed positions to permit or obstruct access to the interior compartment. A latch is typically employed to maintain the closure in its closed position. To open the closure, a vehicle user must pull on a handle to release the latch and manually move the closure to the open position. Some closures are connected to the vehicle body by a check link assembly. The check link assembly establishes a check or stop position between the closed position and the open position and is designed to require additional force to move the door beyond the stop position. The closure is only partially open at the stop position.

SUMMARY

A check link assembly for positioning a vehicle closure has a selectively positionable detent feature to enable adjustment of a check position. The check link assembly includes an elongated link having a distal end. At least one cover is attachable to the link in a first orientation and in a second orientation. The cover has a first end, a second end, and a contoured surface between the first end and the second end. At least one member is biased against the link and is configured to ride against the contoured surface of the cover when there is relative movement of the member and the link. The contoured surface at least partially defines a detent feature that interferes with the biased member to increase resistance to further relative movement of the cover and the link, thereby establishing a check position. The check position is also referred to as a stop position, and the closure connected to the check link is partially open between a closed position and a fully open position when the biased member is at the detent feature in the check position. The detent feature is further from the distal end of the link when the cover is attached to the link in the first orientation than when the cover is attached to the link in the second orientation. For example, if the check link assembly is used on a vehicle door, the detent position of the check link assembly can be adjusted to provide a check position that is further open for larger vehicle owners, or less open for vehicle owners who routinely park in crowded lots. In one embodiment, the cover is attached to the link by fasteners. The vehicle owner can remove the fasteners, turn the cover and refasten the cover to the link to reposition the detent feature of the cover along the link. Thus, an easy to use adjustment is provided to meet customer wants and needs.

The above features and advantages and other features and advantages of the present teachings are readily apparent from the following detailed description of the best modes for carrying out the present teachings when taken in connection with the accompanying drawings.

DETAILED DESCRIPTION

Figure 1:
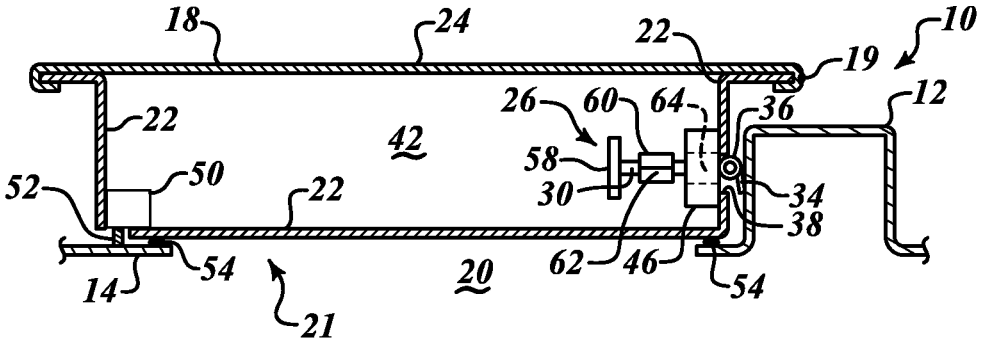
FIG. 1 is a schematic illustration in cross-sectional view of a vehicle door in a closed position relative to a vehicle body, and showing a check link assembly operatively interconnecting the door and the vehicle body.

Referring to the drawings, wherein like reference numbers refer to like components throughout the several views, FIG. 1 shows a portion of a vehicle 10 that includes a vehicle body, represented by a hinge pillar 12, such as an A-pillar, and a portion of a second pillar 14, such as a B-pillar, as understood by those skilled in the art. A vehicle closure, which in this embodiment is a door 18, is pivotably mounted to the hinge pillar 12 via at least one hinge (not shown) as understood by those skilled in the art for pivoting about an axis 19 between a closed position (as shown in FIG. 1) and a fully open position (shown at 18C in FIG. 2). In the closed position, the door 18 covers a door opening 21 at least partially defined by the pillars 12, 14, to prevent ingress and egress from a passenger compartment 20 through the opening 21. The door 18 will not open further than the fully open position 18C. The door 18 includes an inner panel 22 and an outer panel 24 operatively connected to one another, such as by hemming. In other embodiments, the closure could be a deck lid or a hatch door.

A check link assembly 26, also referred to as a "door check" or a "hold open," includes an elongated link referred to as a check link 30. A bracket 34 is mounted to the hinge pillar 12, and is pivotably mounted to the check link 30 such that the check link 30 is selectively pivotable with respect to the hinge pillar 12 about a vertical axis 36 that is substantially parallel to the pivot axis 19 of the door 18.

The check link 30 extends through an aperture 38 formed in the inner panel 22 and into the door cavity 42, which is defined by the inner panel 22 and the outer panel 24. The check link assembly 26 also includes a housing 46 that is disposed within the door cavity 42 and mounted to the inner panel 22. Accordingly, pivoting of the door 18 with respect to the hinge pillar 12 causes relative movement between the housing 46, which is mounted to the door 18, and the check link 30, which is mounted to the hinge pillar 12.

Figure 2:
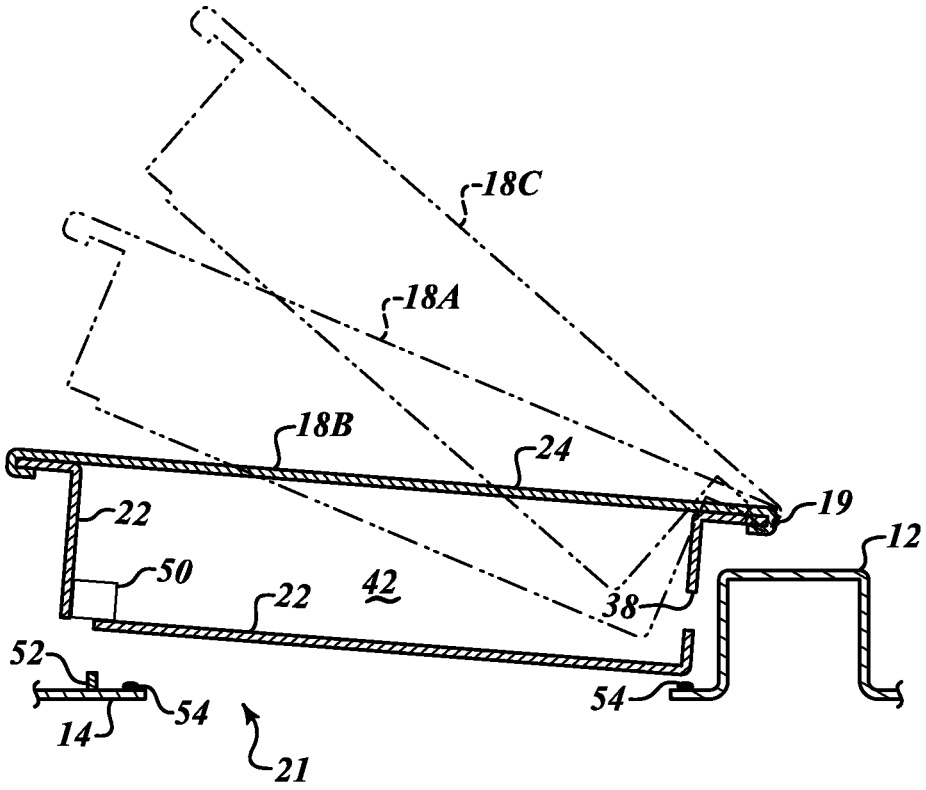
FIG. 2 is a schematic illustration in cross-sectional view of the door and vehicle body of FIG. 1, with the check link assembly removed for purposes of clarity, and showing the vehicle door in a first partially open position, a second partially open position shown in phantom, and a fully open position shown in phantom.

As further explained herein, the check link assembly 26 includes a first cover 60 and a second cover 62 that can be selectively attached to the link 30 in either of two different orientations relative to the link 30 to provide two different check positions, or partially open positions, between the closed position of FIG. 1, and the fully open position 18C of FIG. 2. The first partially open position 18A of FIG. 2 is achieved by the check link assembly 26 when the covers 60, 62 are in the first orientation. The second partially open position 18B of FIG. 2 is achieved when the covers 60, 62 are in the second orientation. In the embodiment of FIGS. 1-7, the covers 60, 62 are identical to one another.

The door 18 includes a latch assembly 50 mounted to the inner panel 22 and positioned within the door cavity 42. A striker 52 is mounted to the hinge pillar 14 and extends through a hole in the inner panel 22 to engage the latch assembly 50 when the door 18 is in the closed position of FIG. 1 so that the latch assembly 50 retains the striker 52 and thereby the door 18 in the closed position. Seals 54 are mounted to the hinge pillars 12, 14 and are positioned to contact the door 18 when the door 18 is in the closed position to seal the door opening 21.

Figure 5:
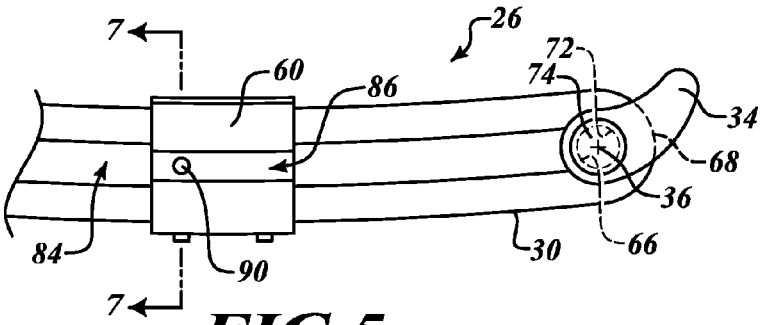
FIG. 5 is a schematic illustration in fragmentary plan view of the check link assembly of FIG. 3.

As shown in FIG. 1, a stop 58 is mounted at one end of the check link 30 to restrict excessive movement of the check link 30 with respect to the housing 46. More specifically, the stop 58 is larger than a passageway 64 in the housing 46 through which the check link 30 extends, and therefore prevents movement of the end of the check link 30 to which the stop 58 is attached through the housing 46 by physically interacting with the housing 46. As best shown in FIG. 5, at an opposite distal end of the check link 30 from the stop 58, the check link 30 defines a hole 66 near a distal end 68 of the check link 30. The bracket 34 is welded or fastened to the pillar 14 and also has a hole 72. The hole 72 in the bracket 34 is aligned with the hole 66 in the check link 30 and a pin 74 is insertable through the aligned holes 66, 72 to pivotably attach the bracket 34 to the link 30.

Figure 3:
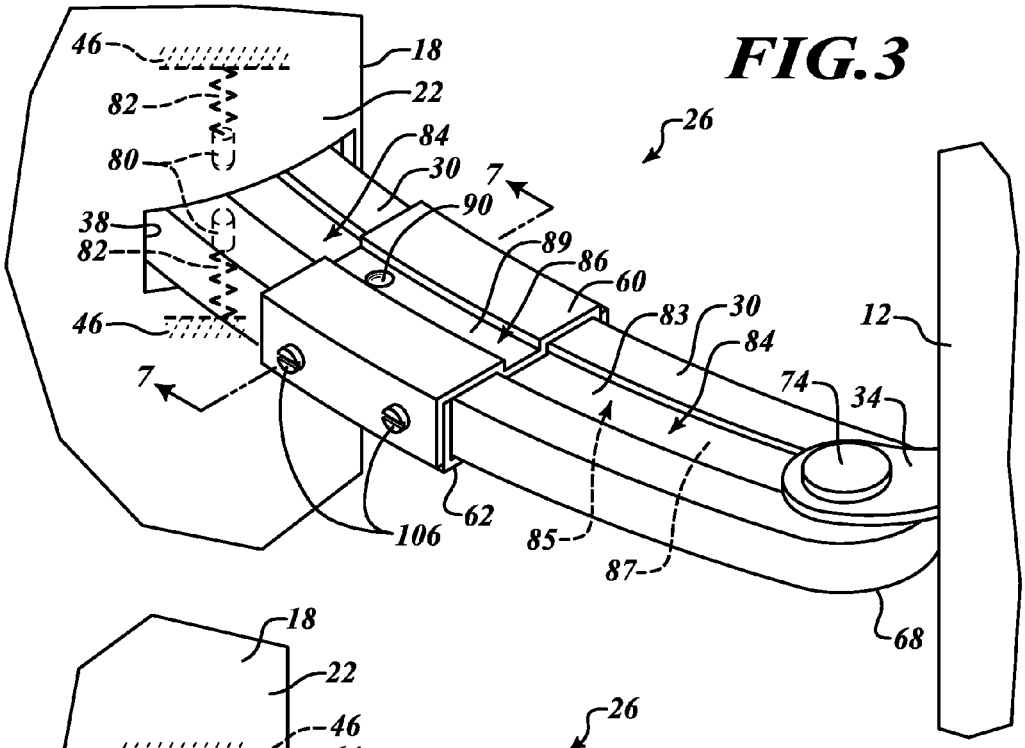
FIG. 3 is a schematic perspective illustration in partial fragmentary view of the check link assembly of FIG. 1 with the door in the fully open position, showing first and second covers attached to a link of the check link assembly in a first orientation.

As shown in FIG. 3, the check link assembly 26 includes contact members 80 that are biased by springs 82 against a surface of the link 30. Specifically, one of the contact members 80 is biased against a first or upper surface 84 of the link 30 and the other contact member 80 is biased against an opposing second or lower surface 85 of the link 30. The first surface 84 is in a channel 83 formed in the link 30 and the second surface 85 is in a channel 87 formed in the link 30. The covers 60, 62 are attached to the link 30 so that the contact members 80 also contact surfaces 86, 88 of the covers 60, 62 as the door 18 is opened from the closed position of FIG. 1 to the open position 18C of FIG. 2. The surface 86 is in a channel 89 formed by the first cover 60 that aligns with the channel 83. The surface 88 is in a channel 91 formed by the second cover 62 that aligns with the channel 87. The surfaces 84, 86 establish a contoured surface against which one of the contact members 80 is biased. The surfaces 85, 88 establish another contoured surface against which the other contact member 80 is biased. Although the springs 82 are depicted as coil springs, other types of springs or materials could be used to bias the contact members 80. For example, torsion springs or rubber pads could be used.

Figure 4:
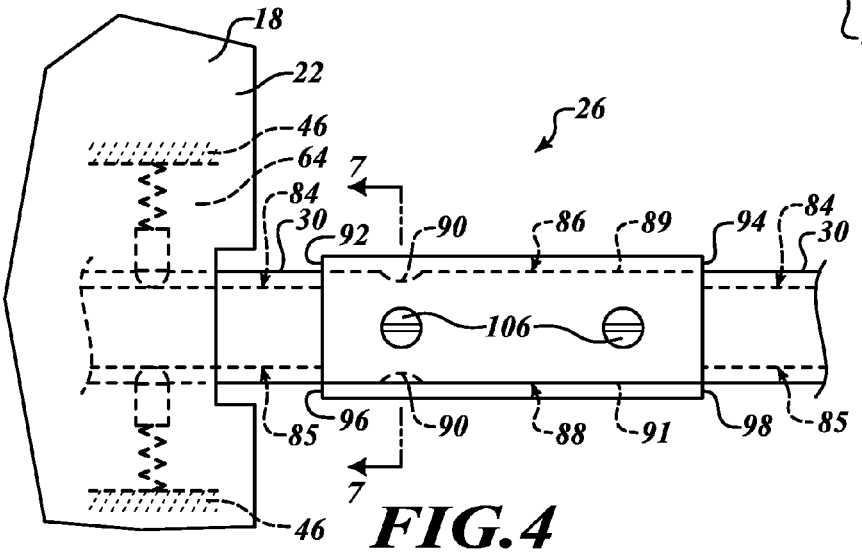
FIG. 4 is a schematic illustration in fragmentary side view of the check link assembly of FIG. 3.

When the door 18 is in the closed position of FIG. 1, the portion of the link 30 at which the covers 60, 62 are attached is within the door cavity 42. When the door 18 is moved toward the open position 18C of FIG. 2, the housing 46 containing the contact members 80 pivots with the door 18 and moves relative to the link 30 so that the contact members 80 move along the link 30 from a position near the distal end 68 shown in FIG. 3, to a position on the opposite side of the covers 60, 62 when the door 18 is at the fully open position 18C of FIG. 2, and as shown in FIGS. 3 and 4. In moving from the closed position to the open position, the contact members 80 must travel over the surfaces 86, 88 of the covers 60, 62. The surfaces 84, 86, together with surfaces 85, 88 are contoured so that they each define a detent feature 90. In the embodiment of FIGS. 1-7, the detent feature 90 is a dimple or recess in each of the cover plates 60, 62. The contact members 80 are pushed by the springs 82 into the detent features 90. Once biased against the surfaces 86, 88 at the detent features 90, at least a predetermined amount of additional force is needed to push the door 18 toward the fully open position. In fact, the detent features 90 serve to stop the door 18 at the stop position or partially open position 18A of FIG. 2 when the covers 60, 62 are in the first orientation shown in FIG. 3. This door check position may be suitable to hold the door in a crowded parking lot. The shape of the contoured surface defining the detent feature 90, that is, the depth of the recess, can be chosen such that a predetermined amount of additional force is needed to continue movement of the door 18 toward the fully open position 18C.

In the first orientation of the covers 60, 62 shown in FIG. 3, the cover 60 is attached at the first surface 84 of the link 30 and the cover 62 is attached at the second surface 85 of the link 30. In other words, one member 80 is biased against the first surface 84 and the surface 86 as the door 18 pivots, and the other member 80 is biased against the second surface 85 and the surface 88 as the door 18 pivots. As shown in FIGS. 3 and 4, in the first orientation of the covers 60, 62, a first end 92 of the first cover 60 is closer to the door 18 and a second end 94 of the first cover 60 is closer to the distal end 68 of the link 30. In the first orientation, a first end 96 of the second cover 62 is closer to the door 18 and a second end 98 of the second cover 62 is closer to the distal end 68 of the link 30.

Figure 6:
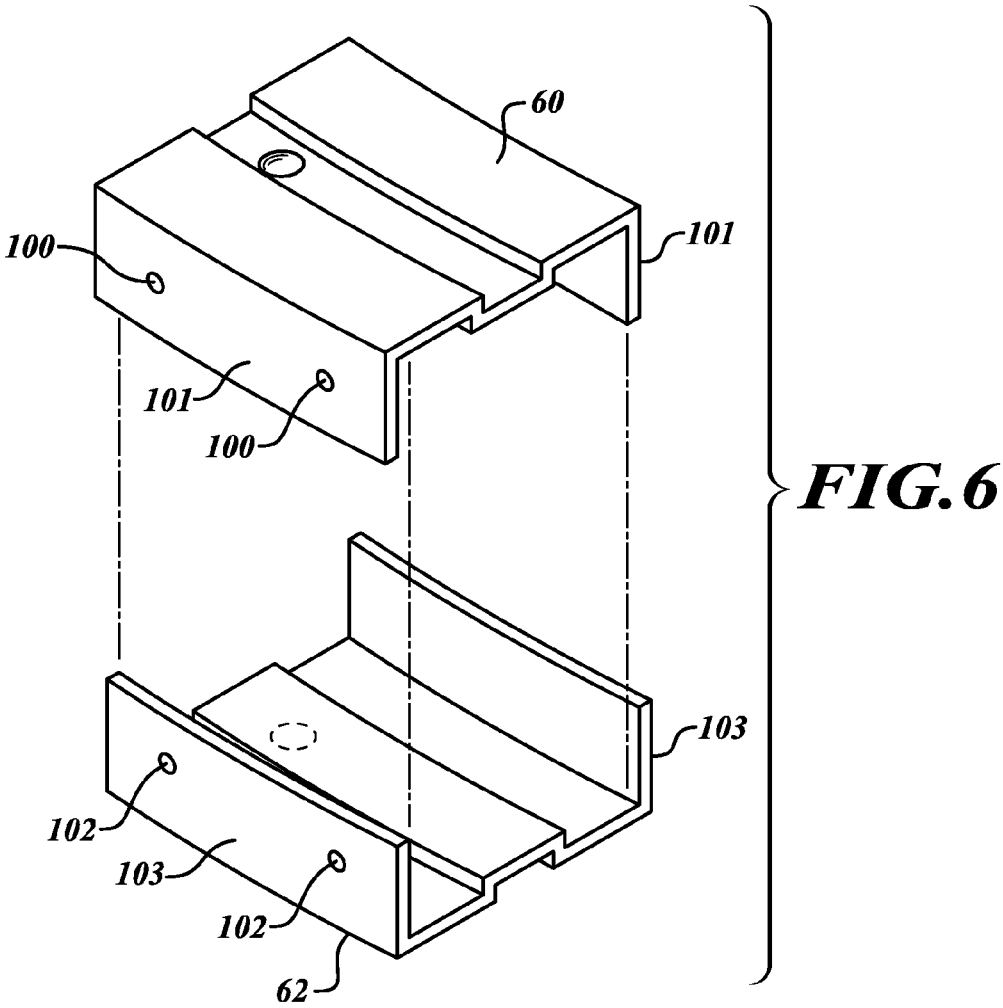
FIG. 6 is a schematic illustration in exploded perspective view of the cover plates of FIG. 3.
Figure 7:
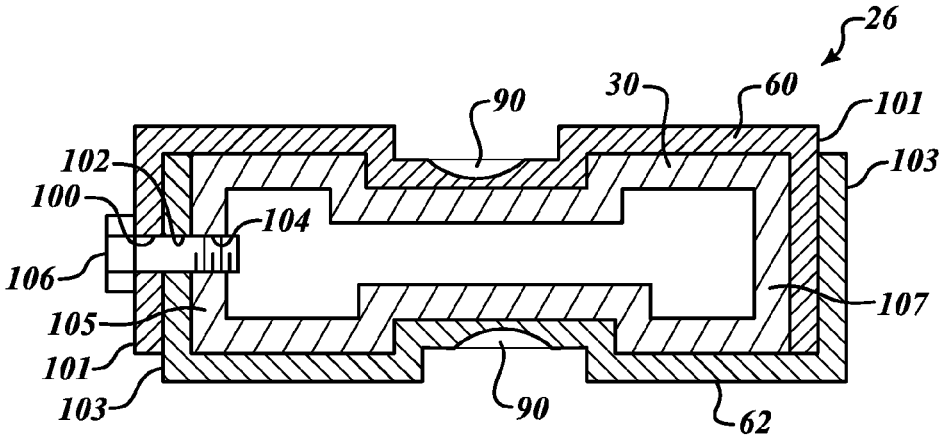
FIG. 7 is a schematic illustration in cross-sectional view of the check link assembly taken at lines 7-7 in FIGS. 4 and 5.

The covers 60, 62 each have sides 101, 103, respectively with openings 100, 102 as shown in FIG. 6. The link 30 also has openings 104 on one side 105, one of which is shown in FIG. 7. The openings 100, 102, and 104 of each pair are equally spaced from one another so that the openings 100, 102, 104 align when the covers 60, 62 are placed on the link 30. The sides 101, 103 of the covers 60, 62 overlap one another when placed on the link 30, as shown in FIG. 7. Fasteners 106 extend through the aligned openings 100, 102, 104 to attach the covers 60, 62 to the link 30. In FIGS. 6 and 7, openings 100, 102 are shown on only one of the sides 101, 103 of each of the covers 60, 62, the fasteners 106 only extend through one pair of overlapping sides 101, 103, and the link 30 only has openings 104 on one side 105. Alternatively, the link 30 could have openings spaced identically to openings 104 on the opposing side 107 of the link 30, and the opposite sides 101, 103 of the covers 60, 62 could also have openings 100, 102 with additional fasteners 106 extending through aligned openings on both sides of the pairs of overlapping sides 101, 103.

Figure 8:
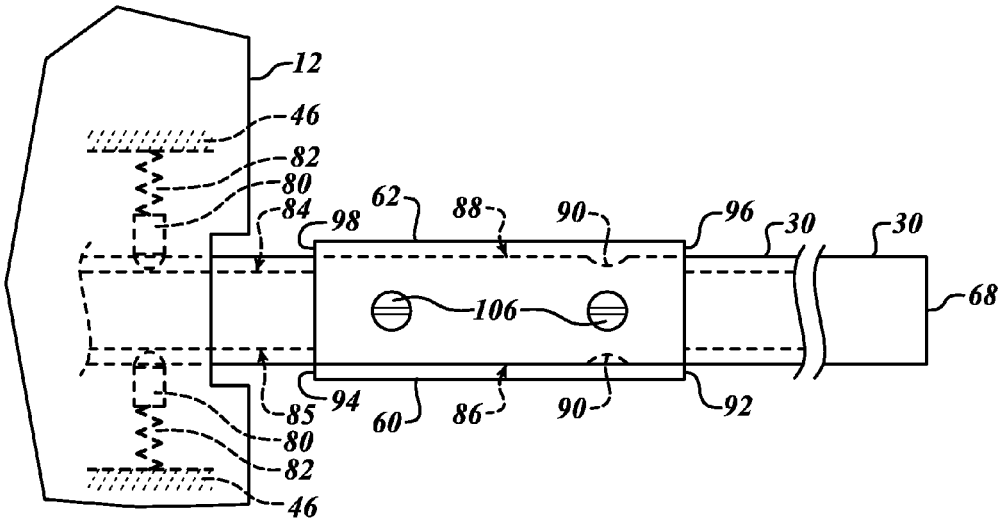
FIG. 8 is a schematic illustration in fragmentary side view of the check link assembly of FIG. 2 with the covers in a second orientation.
Figure 9:
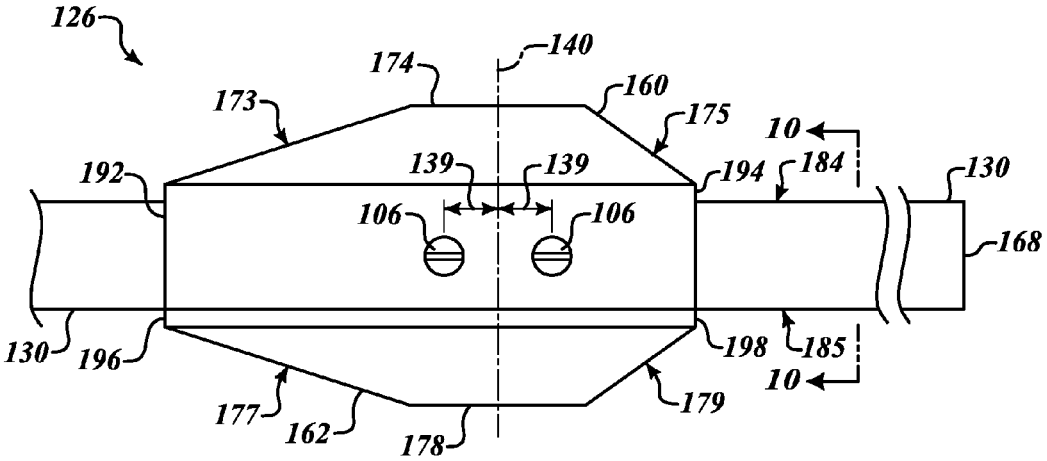
FIG. 9 is a schematic illustration in fragmentary side view of an alternative embodiment of a check link assembly with covers in a first orientation in accordance with an alternative aspect of the present teachings.

In order to modify the check link assembly 26 so that the door 18 has a different stop or check position, also referred to as an intermediate position or partially open position, the covers 60, 62 may be repositioned to a second orientation relative to the link 30, as shown in FIG. 8, so that the detent features 90 of the covers 60, 62 are closer to the distal end 68 of the link 30 than in the first orientation. To move the covers 60, 62 to the second orientation of FIG. 8, the fasteners 106 are removed. The first cover 60 is moved so that the contoured surface 86 is at the second surface 85 of the link 30 and the cover 62 is attached to the link 30 with the contoured surface 88 at the first surface 84 of the link 30. Additionally, each cover 60, 62 is turned 180 degrees relative to its position in the first orientation so that the first ends 92, 96 are closer to the distal end 68 of the link 30 than the second ends 94, 98. The covers 60, 62 are both turned top-to-bottom and end-to-end in this manner because the link 30 is slightly curved from the stop 58 to the distal end 68. If the link 30 were instead straight, then the second orientation could be achieved simply by turning the covers 60, 62 end-to-end and not also moving them to the opposite side of the link 30 from their respective position in the first orientation. Turning the covers 60, 62 "top-to-bottom" means moving the covers 60-62 to opposite sides of the link 30. Turning the covers "end-to-end" means turning each cover 60, 62 180 degrees but not moving the covers 60, 62 to the opposing sides of the link 30.

With the covers 60, 62 in the second orientation of FIG. 8, the detent features 90 will encounter the biased members 80 when the door 18 is in a less open intermediate position 18B of FIG. 2, i.e., closer to the closed position 18 of FIG. 1, because the detent features 90 are closer to the distal end 68 of the link 30 and thus pass under the biased members 80 earlier in the pivoting of the door 18 from the closed toward the open position 18C. When the door 18 is pushed from the closed position toward the fully open position 18C, the door 18 will not pivot as far before the biased members 80 encounter the detent features 90, thus establishing a second hold open position. The covers 60, 62 are selectively detachable from the link 30 to allow the covers 60, 62 to be repositioned to the second orientation, or vice versa, to change the partially open position of the door 18 between position 18A and position 18B.

It should be noted that in FIGS. 3-8, the link 30 is shown with the door 18 in the fully open position 18C of FIG. 2, with the covers 60, 62 and detent features 90 having already passed between the biased members 80; that is, the door 18 has been pivoted beyond the two alternative stop positions provided by the check link assembly 26.

FIGS. 9-12 show another embodiment of a check link assembly 126 that is alike in all aspects to the check link assembly 26 of FIGS. 1-3 except that the link 130 is straight along its length, rather than curved, and covers 160, 162 are used in place of covers 60, 62. The covers 160, 162 are shown attached to the link 130 in a first orientation in FIG. 9. Each of the covers 160, 162 defines a portion of a detent feature. Specifically, cover 160 has a pair of sloped end surfaces 173, 175 each of which partially define a detent feature. The first sloped end surface 173 tapers from a midportion 174 of the cover 160 toward the first end 192 of the cover 160. The second sloped end surface 175 tapers from the midportion 174 toward the second end 194 of the cover 160. The second sloped end surface 175 has a steeper slope than the first sloped end surface 173. The cover 162 has a first sloped end surface 177 that tapers from a midportion 178 toward a first end 196 of the second cover 162. The cover 162 has a second sloped end surface 179 that tapers from the midportion 178 toward a second end 198 of the second cover 162. The second sloped end surface 179 has a steeper slope than the first sloped end surface 177. The first sloped end surface 173 can have the same slope as the first sloped end surface 177 and the second sloped end surface 175 can have the same slope as the second sloped end surface 179.

Figure 10:
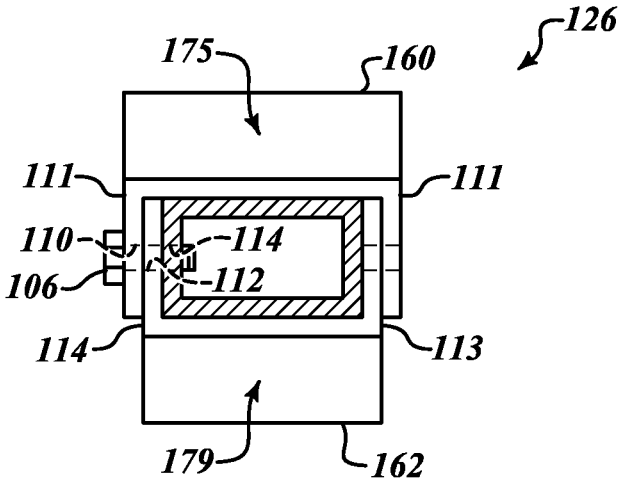
FIG. 10 is a schematic illustration in cross-sectional view of the check link assembly of FIG. 9 taken at lines 10-10 in FIG. 9.
Figure 11:
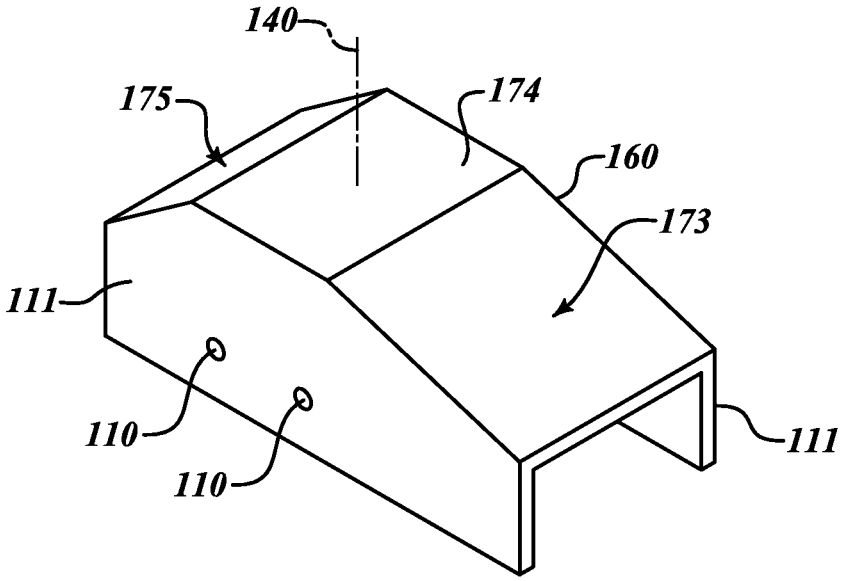
FIG. 11 is a schematic perspective illustration of one of the covers of FIG. 9.
Figure 12:
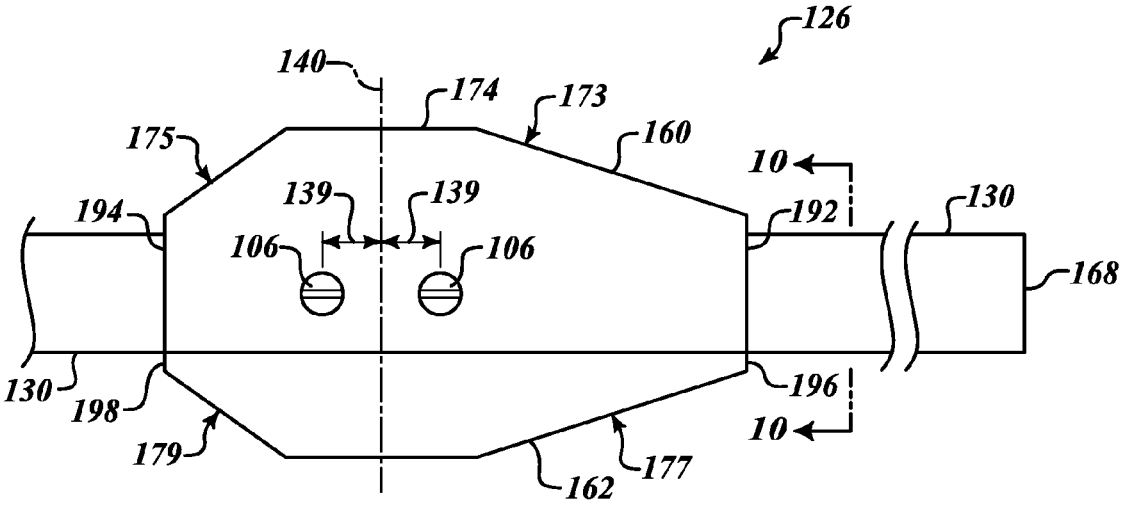
FIG. 12 is a schematic illustration in fragmentary side view of the check link assembly of FIG. 9 with the covers in a second orientation

The cover 160 has a pair of openings 110 through both sides 111 of the cover 160, as shown in FIG. 10. The cover 162 has a pair of openings 112 through both sides 113 of the cover 162. The link 130 has a pair of openings 114 on only one side of the link 130. The openings 110, 112, 114 align with one another to allow the covers 160, 162 to be attached to the link 130 by fasteners 106 extending through the aligned openings 110, 112, 114. As shown in FIG. 12, the openings 110, 112, and 114 are each equally spaced a distance 139 along the length of the link from a center axis 140 that extends through a center of the midportion 174, equidistant from both of the sloped surfaces 173, 175. The biased members 80 of FIG. 3 will first encounter the ends 194, 198 of the covers 160, 162 when the members 80 are biased against the surfaces 184, 185 of the link 130. The surfaces 175, 179 form a portion of a detent feature to increase resistance to travel of the members 80 as the door 18 pivots open, establishing a first partially open position or check position similar to position 18A in FIG. 2. If additional force is applied, the springs 82 will compress and the members 80 will continue to move along the surfaces 175, 179, and the door 18 will open wider, up to the fully open position 18C.

In order to modify the check link assembly 126 so that the door 18 has a different stop or check position, also referred to as an intermediate position or partially open position, the covers 160, 162 may be repositioned to a second orientation relative to the link 130, as shown in FIG. 12, so that the surfaces 173, 177 establish a detent feature of the covers 160, 162 that is closer to a distal end 168 of the link 130 than the detent feature established by the surfaces 175, 179. The link 130 can be attached by the bracket 34 to the pillar 12 near the distal end 168, similar to the attachment of the link 30 in FIG. 3.

To move the covers 160, 162 to the second orientation of FIG. 12, the fasteners 106 are removed. The first cover 160 is turned 180 degrees about the axis 140 so that the end 192 is closer to the distal end 168 and the second cover 162 is turned 180 degrees about the axis 140 so that the end 196 is closer to the distal end 168. In contrast to the covers 60, 62, it is not also necessary to move the covers 160, 162 to opposite sides of the link 130 when changing between the first orientation and the second orientation, although moving the covers 160, 162 in this manner would still achieve a different second configuration. Because the first sloped end surfaces 173 and 177 are different from the second sloped end surfaces 175 and 179 and the openings 100, 102 are equidistant from the center axis 140, the ends 192, 196 are closer to the distal end 168 than the ends 194, 198 were when the covers 160, 162 were in the first orientation of FIG. 9. The ends 192, 196 are thus encountered by the members 80 earlier in the pivoting of the door 18 from the closed position of FIG. 1 to the fully open position 18C.

In the second orientation, therefore, the partially open position or intermediate position established by the check link assembly 126 is nearer the closed position than when the covers 160, 162 are in the first orientation. Because the slopes of the surfaces 175, 179 are greater than the slopes of the surfaces 173, 177, a greater predetermined amount of force to move the door 18 beyond the check position to the fully open position is required when the covers 160, 162 are in the first orientation of FIG. 9 than when the covers 160, 162 are in the second orientation of FIG. 12.

Figure 13:
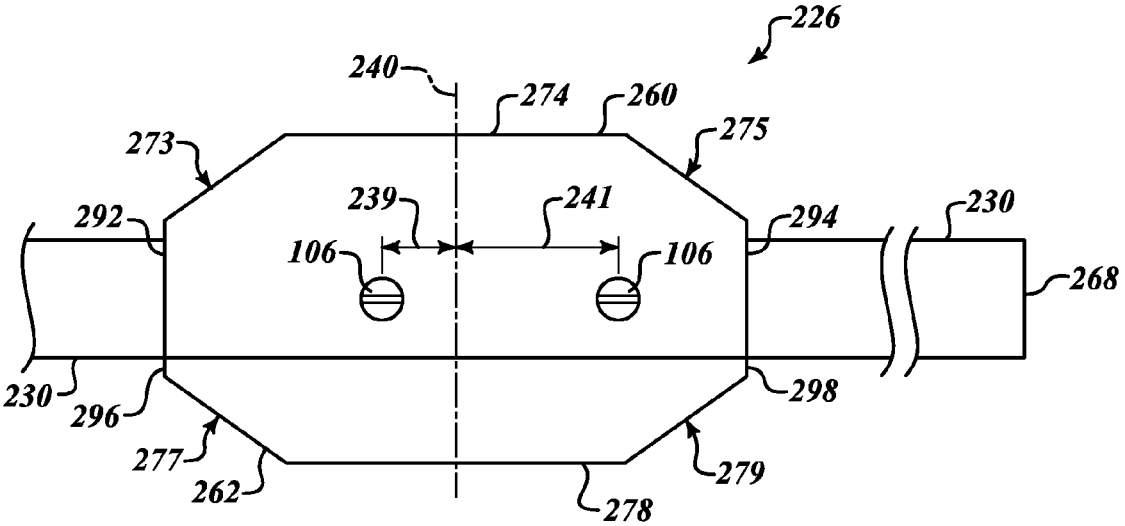
FIG. 13 is a schematic illustration in fragmentary side view of an alternative embodiment of a check link assembly in accordance with an alternative aspect of the present teachings.

FIG. 13 shows another alternative embodiment of a check link assembly 226 for use with the door 18 of FIG. 1. The check link assembly 226 has two covers 260, 262 shown attached to the link 230 in a first orientation in FIG. 13. The first cover 260 has first and second sloped end surfaces 273, 275. The second cover 262 has first and second sloped end surfaces 277, 279. Each of the sloped end surfaces 273, 275, 277, 279 has the same slope. A respective pair of openings is provided through each of the check link 230, the first cover 260 and the second cover 262. Each pair of openings is spaced asymmetrically about a center axis 240 through the midportions 274, 278 of the covers 260, 262 as represented by the positions of the fasteners 106 in FIG. 13. That is, each of the check link 230, the first cover 260 and the second cover 262 has a first opening a distance 241 along the length of the link 230 from the center axis 240, and a second opening a distance 239 along a length of the link 230 from the center axis 240. The openings of the first cover 260, of the second cover 262, and of the link 230 are not visible in FIG. 13 as they are covered by the fasteners 106. The openings of the first cover 260, of the second cover 262, and of the link 230 are at the positions of the fasteners 106, which extend through the openings.

The distance 241 is greater than the distance 239. The covers 260, 262 can be attached to the link 230 in a second orientation by removing the fasteners 106 and turning each cover 260, 262 by 180 degrees, and then reattaching the covers 260, 262 with fasteners 106 through the aligned openings of the covers 260, 262 and the link 230. The link 230 remains attached by the bracket 34 to the pillar 12 near the distal end 268, similar to the attachment of the link 30 in FIG. 3. Because of the asymmetric offset of the openings about the center axis 240, the ends 292, 296 will be closer to the distal end 268 when the covers 160, 162 are turned 180 degrees to establish the second orientation than the ends 294, 298 are in the first orientation shown in FIG. 13. The check position is thus selectively adjusted by repositioning the covers 260, 262.

While the best modes for carrying out the many aspects of the present teachings have been described in detail, those familiar with the art to which these teachings relate will recognize various alternative aspects for practicing the present teachings that are within the scope of the appended claims.

The invention claimed is:

1. A check link assembly for positioning a vehicle closure:

an elongated link having a distal end;

at least one cover attachable to the link in a first orientation and in a second orientation and having a first end, a second end, and a contoured surface between the first end and the second end;

at least one member biased against the link and configured to ride against the contoured surface of said at least one cover when there is relative movement of said at least one member and the link;

wherein the contoured surface at least partially defines a detent feature that interferes with said at least one member to increase resistance to further relative movement of said at least one member and the link, thereby establishing a check position;

wherein the detent feature is further from the distal end of the link when said at least one cover is in the first orientation than when said at least one cover is in the second orientation, thereby enabling adjustment of the check position by switching between the first orientation and the second orientation;

wherein said at least one cover includes a first cover and a second cover substantially identical to the first cover; wherein the link has a first surface and a second surface opposite the first surface; wherein the first cover is at the first surface and the second cover is at the second surface in the first orientation; and wherein the at least one member includes a first member that rides along the contoured surface of the first cover and a second member that rides along the contoured surface of the second cover.

2. The check link assembly of claim 1, wherein the contoured surface of said at least one cover has a first slope extending from the first end and a second slope extending from the second end; and wherein the cover is turned end-to-end in the second orientation relative to the first orientation.

3. The check link assembly of claim 2, further comprising:

fasteners configured to attach said at least one cover to the link;

wherein both the link and said at least one cover have openings configured to align with one another and receive the fasteners; and wherein the openings of said at least one cover are positioned relative to the ends of the link so that the detent feature is further from the distal end of the link when said at least one cover is in the first orientation than when said at least one cover is in the second orientation.

4. The check link assembly of claim 3, wherein the first slope is different than the second slope and the openings are symmetrically positioned relative to a center axis of a midportion of said at least one cover between the first slope and the second slope.

5. The check link assembly of claim 3, wherein the first slope is the same as the second slope and the openings are asymmetrically positioned relative to a center axis of a midportion of said at least one cover between the first slope and the second slope.

6. The check link assembly of claim 1, wherein the link is curved; wherein the first cover is at the second surface and the second cover is at the first surface in the second orientation; and wherein both of the covers are turned end-to-end in the second orientation relative to the first orientation.

7. The check link assembly of claim 1, wherein each of the first cover and the second cover has sides extending from the contoured surface; wherein the sides of the first cover overlap with the sides of the second cover when the first and second covers are attached to the link.

8. The check link assembly of claim 1, further comprising:

a fastener; wherein said at least one cover and the link each have an opening; wherein the opening of said at least one cover is aligned with the opening of the link and the fastener is received through the aligned openings when said at least one cover is attached to the link in the first orientation and in the second orientation.

9. The check link assembly of claim 1, wherein the detent feature is a recess.

10. A vehicle comprising:

a vehicle body defining a closure opening;

a closure connected to the vehicle body and pivotable between a closed position in which the closure opening is closed by the closure, and an open position in which the closure opening is at least partially uncovered by the closure;

an elongated link having a distal end and connected to one of the closure and the vehicle body so that there is relative movement between the link and said one of the closure and the body when the closure is pivoted between the closed position and the open position;

at least one cover attached to the link at an outer surface of the link in a first orientation and attached to the link at the outer surface of the link when in a second orientation and having a first end, a second end, and a contoured surface between the first end and the second end;

at least one member continuously biased toward the outer surface of the link so that said at least one member rides against the link and against the contoured surface of said at least one cover when the closure moves from the closed position to the open position;

wherein the contoured surface at least partially defines a detent feature that interferes with said at least one member to increase resistance to movement of the closure; and wherein the detent feature is further from the distal end of the link when said at least one cover is in the first orientation than when said at least one cover is in the second orientation so that the closure is in a first partially open position when said at least one cover is in the first orientation and is in a second partially open position that is between the closed position and the first partially open position when said at least one cover is in the second orientation.

11. The vehicle of claim 10, wherein said at least one cover includes a first cover and a second cover substantially identical to the first cover; wherein the outer surface of the link includes a first surface and a second surface opposite the first surface; wherein the first cover is at the first surface and the second cover is at the second surface in the first orientation; wherein said at least one member includes a first member that rides against the contoured surface of the first cover and a second member that rides against the contoured surface of the second cover.

12. The vehicle of claim 11, wherein the detent feature is a recess.

13. The vehicle of claim 11, wherein the link is curved; wherein the first cover is at the second surface and the second cover is at the first surface in the second orientation; and wherein both of the covers are turned end-to-end in the second orientation relative to the first orientation.

14. The vehicle of claim 11, wherein each of the first cover and the second cover has sides extending from the respective contoured surfaces; wherein the sides of the first cover overlap with the sides of the second cover when the first and second covers are attached to the link.

15. The vehicle of claim 10, wherein the contoured surface has a first slope extending from the first end and a second slope extending from the second end; and wherein said at least one cover is turned end-to-end in the second orientation relative to the first orientation.

16. The vehicle of claim 10, further comprising:

fasteners configured to attach said at least one cover to the link;

wherein both the link and said at least one cover have openings configured to align with one another and receive the fasteners; and wherein the openings of said at least one cover are positioned relative to the ends of the link so that the detent feature is further from the distal end of the link when said at least one cover is in the first orientation than when said at least one cover is in the second orientation.

17. The vehicle of claim 15, wherein the first slope is different than the second slope and the openings are symmetrically positioned relative to a center axis of said at least one cover.

18. The vehicle of claim 15, wherein the first slope is the same as the second slope and the openings are asymmetrically positioned relative to a center axis of said at least one cover.

19. A check link assembly for positioning a vehicle closure between a fully closed position and a fully open position relative to a vehicle body:

an elongated link connectable to one of the closure and the vehicle body and having a distal end;

at least one cover attachable to the link in a first orientation and in a second orientation and having a first end, a second end, and a contoured surface between the first end and the second end;

at least one member continuously biased toward the link by a spring and configured to ride against the link and against the contoured surface of said at least one cover when the closure moves;

wherein the contoured surface at least partially defines a detent feature that causes the spring to compress to increase resistance to further movement of the closure, thereby establishing an intermediate position of the closure between the fully closed position and the fully open position at which the closure stops unless at least a predetermined amount of force is applied to the closure; and wherein the intermediate position is further from the closed position when said at least one cover is in the first orientation than when said at least one cover is in the second orientation.

* * * * *